US006131659A

United States Patent [19]

Johnson

[11] Patent Number: 6,131,659

[45] Date of Patent: Oct. 17, 2000

[54] DOWNHOLE WELL CORROSION MONITORING APPARATUS AND METHOD

[75] Inventor: Barry Vincent Johnson, Dhahran, Saudi Arabia

[73] Assignee: Saudi Arabian Oil Company, Dhahran, Saudi Arabia

[21] Appl. No.: 09/116,052

[22] Filed: Jul. 15, 1998

[51] Int. Cl.[7] ..... E21B 49/00

[52] U.S. Cl. ..... 166/250.05; 73/152.57; 166/242.4; 166/902

[58] Field of Search ..... 166/250.05, 242.4, 166/902; 73/152.57

[56] References Cited

U.S. PATENT DOCUMENTS

| | | | |
|---|---|---|---|
| 3,683,680 | 8/1972 | Johnson et al. | 73/67.7 |
| 4,539,846 | 9/1985 | Grossman | 73/579 |
| 4,646,565 | 3/1987 | Siegfried | 73/152 |
| 4,872,345 | 10/1989 | Dicks | 73/597 |
| 4,909,091 | 3/1990 | Ellmann et al. | 73/866.5 |
| 4,912,683 | 3/1990 | Katahara et al. | 367/25 |
| 4,986,350 | 1/1991 | Czernichow | 166/65.1 |
| 5,171,524 | 12/1992 | Niolon | 422/53 |
| 5,431,054 | 7/1995 | Reeves et al. | 73/612 |
| 5,446,369 | 8/1995 | Byrne et al. | 324/71.2 |
| 5,526,689 | 6/1996 | Coulter et al. | 73/592 |
| 5,533,572 | 7/1996 | Brady et al. | 166/250.05 |

OTHER PUBLICATIONS

Schlumberger, "Corrosion Monitoring", (Content: Sections 1 through 7, Slides 401–443) (Appears to be Industrial Manual, no publication date.).

*Primary Examiner*—William Neuder
*Attorney, Agent, or Firm*—Abelman, Frayne & Schwab

[57] ABSTRACT

The existence and rate of corrosion in a section of a well tubing or well casing string is determined and monitored continuously or intermittently by installing at predetermined locations as the string is placed in the well bore, sections of pipe that have been fitted with an array of piezoelectric transducers positioned around the circumference of the pipe and a microprocessor that controls signals going to and from each array of transducers and signals going to and received from controls and instrumentation apparatus located at the earth's surface. The apparatus can also include a reference block isolated from corrosion sources that is fitted with transducers associated with the microprocessor for the adjacent array of transducers. The microprocessors at varying locations along the string are electrically connected to the surface control and instrumentation apparatus by conductor cables and/or by wireless means using the pipe string as the conductive path for electrical signals.

27 Claims, 6 Drawing Sheets

FIG. 1
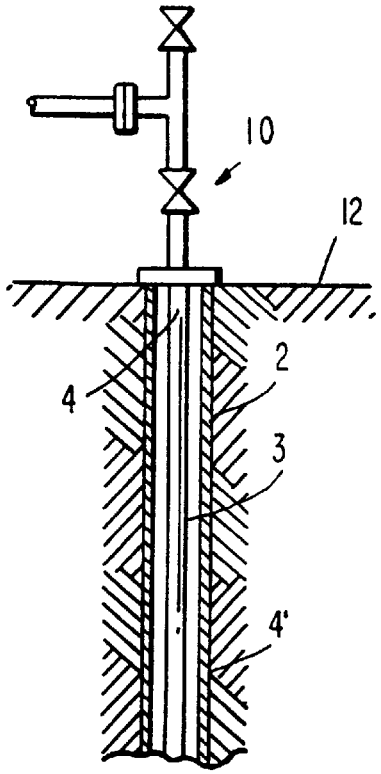
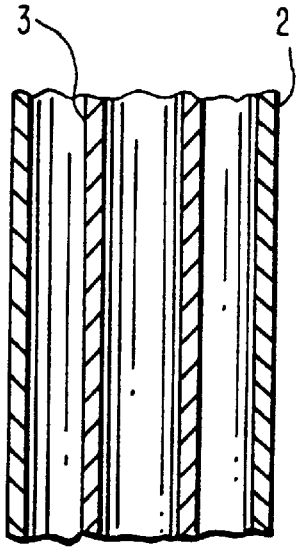
FIG. 2
FIG. 4A
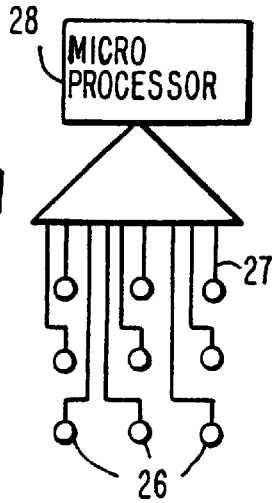

DOWNHOLE WELL CORROSION MONITORING APPARATUS AND METHOD

FIELD OF THE INVENTION

The invention relates to the ultrasonic monitoring of the condition of well tubing and well casing strings during operation or while the well is shut-in to identify the onset and location of corrosion, and its rate of progress in any type of well environment, including oil, gas, water and multiphase fluids.

BACKGROUND OF THE INVENTION

A variety of devices and methods have been employed in an effort to detect and/or monitor the progress of corrosion in well tubing strings, or pipes, and well casing strings, and the process is broadly referred to as "downhole" corrosion monitoring. As used herein, "corrosion" includes such defects as metal loss, pitting and cracking which, if left unchecked, can progress to result in a failure of the pipe.

Downhole corrosion monitoring is particularly important in the operation and management of oil gas or water wells and fields, not only in predicting the useful life of the well tubing and casings, for the purpose of avoiding failures during operation, but also in determining the efficacy of chemical additives intended to minimize such corrosion.

Although the methods presently employed for monitoring downhole corrosion vary, they all require the use of wire lines to install and/or retrieve devices placed at predetermined positions or the running of logging tools. These prior art methods include wireline logging tools that are attached to the end of a wire or cable; coupons set and recovered by wireline; and programmable electronic probes set and retrieved by wireline. In order to use any of these methods, the well has to be taken out of service. Shutting down the well on a regular schedule for corrosion monitoring is costly, not only in terms of direct labor charges, but also in terms of lost production and revenues. Additionally, disruption of the flow due to the installation of intrusive devices in the wellbore can give rise to misleading corrosion rate data.

Apparatus and methods utilizing ultrasound to measure piping wall thickness and to detect defects are known for installed well tubing and casing, but must be run by wireline and suffer the same limitations as all such intrusive tools. Also, because of the imprecise positioning of the wireline tools from one inspection to the next, it is not possible to obtain reliable data on the in situ rate of corrosion. Another major limitation of existing ultrasonic wireline devices is the requirement that they need to be run in a liquid-filled tube in order to transmit data. This requirement limits their use in multi-phase and gas wells.

It is therefore an object of this invention to provide an apparatus and method that will permit downhole corrosion monitoring without taking the well out of service or disrupting the flow, and that can be used in all types of well service, i.e., water, oil, gas and/or multi-phase wells.

It is another object of the invention to permit corrosion monitoring data to be obtained and analyzed with any desired frequency, or even continuously.

Another object of the invention is to permit corrosion monitoring data to be obtained from the time of the installation of well tubing and/or well casing strings to provide a baseline, and thereby to identify the onset of corrosion as well as its rate of progress in the section or sections of tubing being monitored.

It is also an object of the invention to provide an economical and cost-effective method and apparatus for in situ downhole corrosion monitoring that will provide reliable data without resort to wirelines and intrusive tools and methods.

SUMMARY OF THE INVENTION

The above objects and further benefits and advantages are realized from the apparatus and method of the invention which comprises providing a plurality of piezoelectric transducers that are attached to the metal surface of a section of well casing or tubing in a predetermined and fixed array. In the first preferred embodiment, the plurality of transducers forming a given fixed array are electrically connected by conductors to at least one microprocessor that is positioned proximate to the transducer array. The microprocessor is also electrically connected to a conductor cable that leads from the downhole position of the casing or tubing section to a surface facility where there is a power supply, computer-directed control and instrumentation means, data processing and storage means, and display means, such as a printer and/or CRT monitor. In another preferred embodiment, a wireless system can be employed in which the microprocessors are connected electrically to the casing or tubing string which serves as the conductor to relay power signals and data between the surface instrumentation and the microprocessors.

In a preferred embodiment, a reference block fabricated from the same material as the pipe being monitored is installed proximate the corrosion monitoring transducer array. The reference block is isolated from any corrosion sources. The reference block can preferably be in the form of a step-wedge having a plurality of predetermined thicknesses corresponding, for example, to the original thickness of the wall of the section of pipe being monitored, one or more intermediate lesser thicknesses, the thinnest section of the wedge corresponding to the predetermined minimum safe thickness of the casing or tubing pipe wall that will permit continued operation of the well. Transducers are also attached to each of the surfaces forming the steps on the reference block, and these transducers are electrically connected to a microprocessor, which can be the same microprocessor associated with the fixed array of transducers, or to a separate microprocessor which in turn is connected by cable to the surface control facility, or alternatively directly to the casing or tubing string if a wireless system is being used.

In a preferred embodiment of the invention, the fixed array of transducers, the reference block with transducers and the associated microprocessor, or microprocessors, are affixed in a short section of connector pipe that is used to join the standard lengths of well casing and/or tubing pipes. The use of short sections of connector pipe facilitates the assembly of the monitoring apparatus, and also its placement in the well bore. Since the connectors are required in any event to join sections of pipe as the string proceeds into the well bore, little additional time and labor is required to provide the capability for periodic or essentially continuous corrosion monitoring at any desired number of vertical locations along the pipe string. In the practice of the method of the invention, the principal additional steps required at the well head are the connection and securing of the conductor cable which is to transmit signals from the facility at the surface and to receive data from the microprocessors. However, in the practice of the embodiment employing a wireless system, these additional steps are not required.

In the practice of the method, a general purpose computer is provided with appropriate software to generate a signal to activate each microprocessor and the signal is transmitted via the conductor cable, or alternatively, using wireless transmission means in which the piping string serves as a conductor. Upon receipt of the activation signal, each microprocessor activates its associated transducers and receives the data generated relating to the condition of the casing or tubing string to which the transducer is attached, or in the case of the reference block, receives baseline or comparative data from the block that is isolated from the sources of potential corrosion. The microprocessor(s) at each location being monitored then transmit data via the conductor cable or wireless transmission means to the surface facility. The data is received by the computer-directed control and instrumentation means, from which it can either be transferred directly to data storage means, or first to data processing means and then to the data storage means. Once the data has been processed it is available for display either in printed form or it is displayed visually on a CRT monitor.

Various other embodiments and configurations of the apparatus and the method of the invention will be apparent to those of ordinary skill in the art from the following detailed description of the invention.

BRIEF DESCRIPTION OF THE DRAWINGS

FIG. 1 is a simplified sectional schematic illustration of a typical well producing liquid or gaseous hydrocarbons, water, or multi-phase fluids;

FIG. 2 is an enlarged segmented cross-sectional view along line II—II of FIG. 1;

FIG. 4A is a schematic electrical diagram showing a detail of an element from FIG. 4;

DETAILED DESCRIPTION OF THE PREFERRED EMBODIMENTS

As shown in the simplified illustration of FIG. 1, a well 10 producing reservoir fluid includes a casing string 2 that surrounds a tubing string 3 that extends down into the ground to the reservoir rock from which the reservoir fluids are being extracted. Each of the strings comprises lengths of pipe 4 joined by connectors (not shown.) The pipes comprising the casing string are lowered into place as the well is being drilled and secured together by any of a variety of pipe connectors. Thereafter, the lengths of pipe comprising the tubing string are lowered into the casing to provide the conduit through which the reservoir fluids are drawn from the reservoir. The spatial relationship of the lengths of pipe comprising the casing and tubing is shown in FIG. 2.

Figure 3:
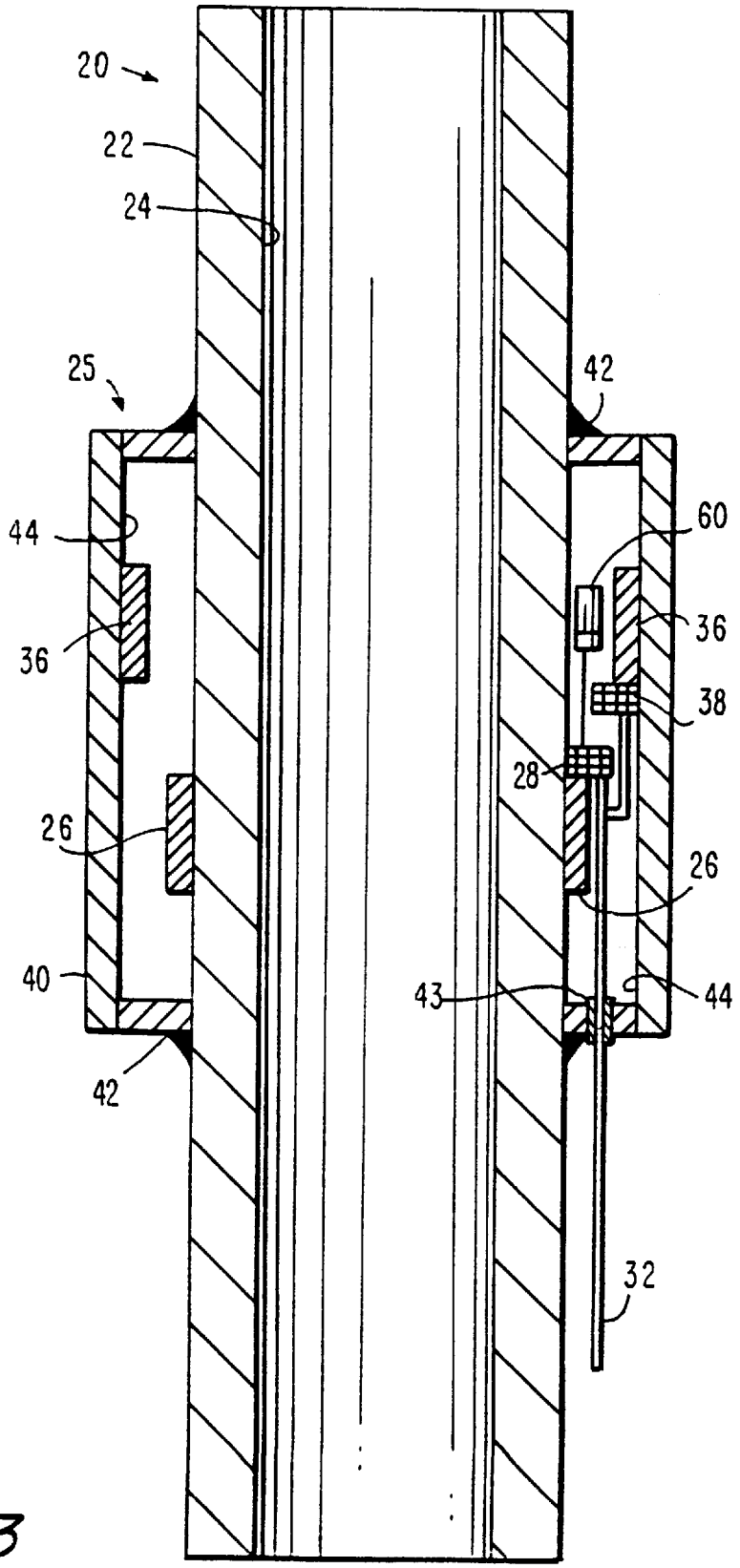
FIG. 3 is a cross-sectional view of a segment of well casing illustrating one preferred embodiment of the invention.

In one preferred embodiment of the invention schematically illustrated in FIG. 3, a short section of casing pipe 20 is provided with a plurality of piezoelectric transducers 26 that are attached to exterior casing surface 22 in a fixed array. In an especially preferred embodiment, the fixed array comprises at least three longitudinally-spaced rows and each row contains at least three transducers that are radially spaced around the circumference of the pipe, i.e., at 120° intervals. The fixed array of transducers 26 is electrically connected by conductors 27 to at least one microprocessor 28. In a preferred embodiment, the one or more microprocessors are located in close proximity to the associated transducer array.

Figure 4:
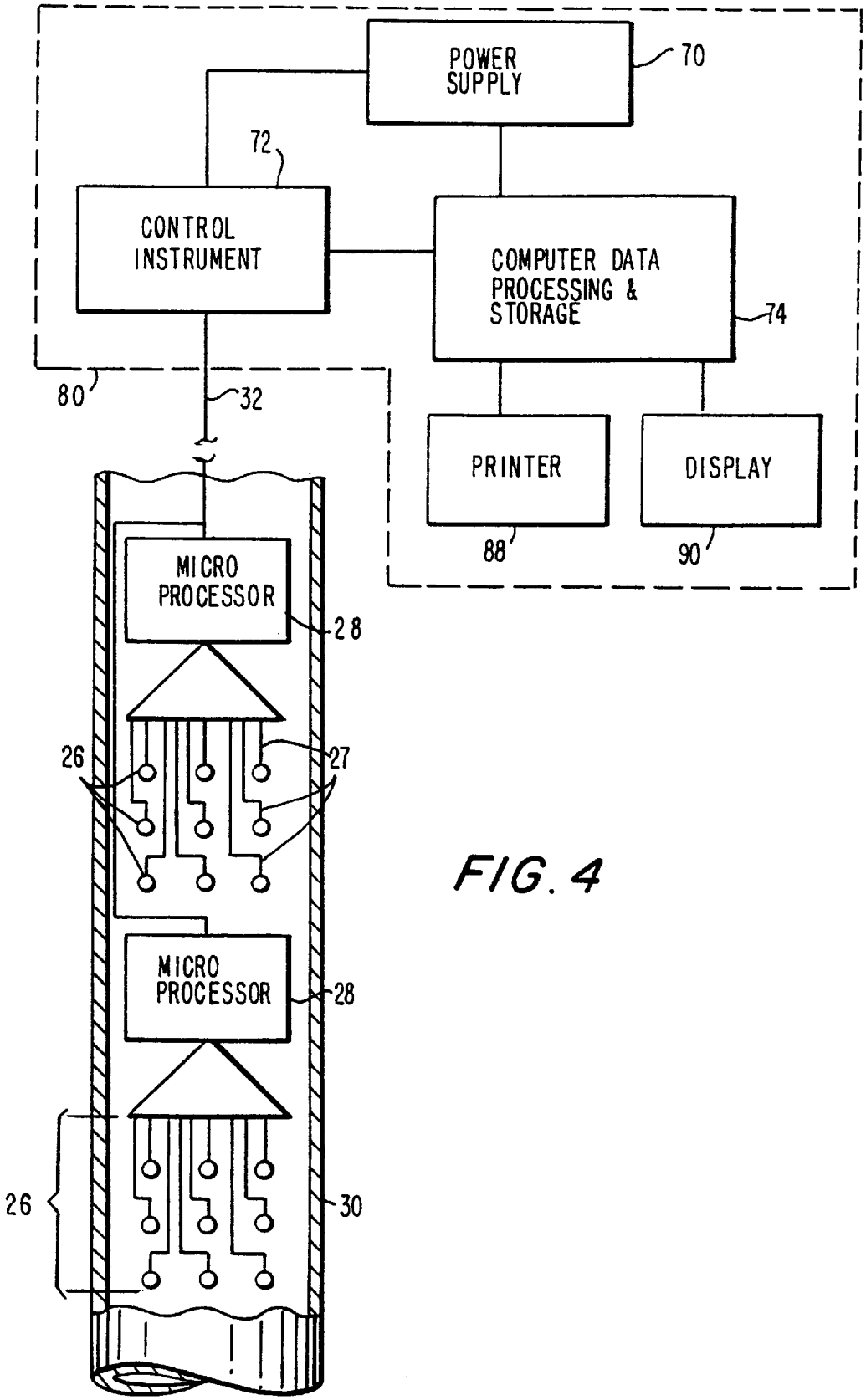
FIG. 4 is a schematic electrical diagram illustrating a preferred embodiment of the invention shown in FIG. 3.

With reference to the schematic of FIG. 4, conductor cable 32 extends from a plurality of microprocessors 28 to a surface facility 80 comprised of a power supply 82 and associated computer-directed control and instrumentation 84, data processing and storage means 86, and printing means 88 and display means 90 located at the surface, preferably in a mobile or permanent facility.

The control and instrumentation means includes a general purpose computer and software program to activate each individual microprocessor and each of its associated transducers, to receive the data from each of the microprocessors, and to thereafter relay the data either for storage or for processing.

In an alternative preferred embodiment, the data received at the surface is relayed from the surface control means via, e.g., a telemetry unit or a land line (not shown) for processing and storage at a location remote from the well. This embodiment is particularly adapted for monitoring the condition of one or more wells in isolated areas or at great distances from field service offices.

In accordance with methods and procedures well-known in the prior art, signals generated by the computer-directed instrumentation and control means 84 are transmitted via conductor cables 32 to each of the microprocessors 28, which in turn are activated to transmit signals to the array of transducers 26 associated with each microprocessor. The signals generated and received by the arrayed transducers are returned to their associated microprocessor 28 for transmission to the data receiving, processing and storage means 86 in the surface facility 80.

The data can be processed prior to being stored in the memory device, or thereafter. The processed data itself is sorted and/or made available for transmission to a display device. The condition of the section of well casing or tubing being monitored is displayed in numerical and/or graphical terms on a computer monitor 90 and/or printout 88, and the data is entered in an appropriate data storage or memory device 86.

In the further preferred embodiment of the invention shown in FIG. 3, the transducer array and associated microprocessor are enclosed in a protective cover 40 secured to the exterior of the pipe, as by weldments 42. Conductor 32 passes through fluid-tight gaskets or gland 43 positioned in the cover 40, which cover is preferably fabricated from a material that is the same as, or very similar to that from which the tubing or casing string to which it is attached. In order to monitor the condition of the exterior surface of a section of the tubing or casing, a second array of transducers 36 is affixed to the interior surface 44 of protective cover 40 and attached by appropriate conductors to associated microprocessor 38, which in turn is electrically connected to conductor cable 32. Thereafter, appropriate signals are transmitted to and received from the exterior array of transducers and the data is processed for display as described above in connection with the method and apparatus for monitoring the condition of a section of the interior of the tubing or casing string.

Figure 7:
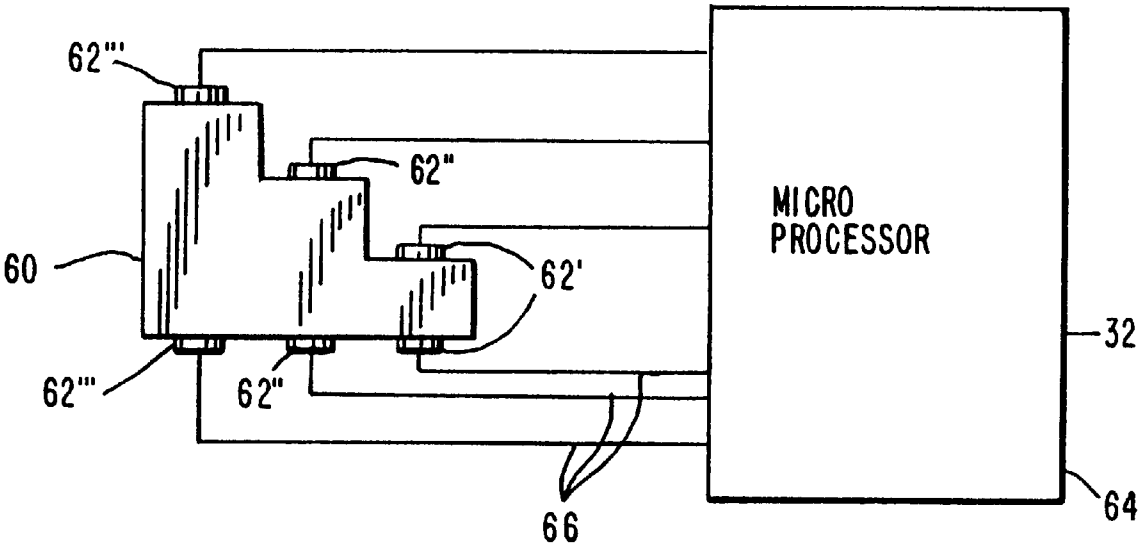
FIG. 7 is a side elevational view of a typical reference block arrangement.
Figure 7B:
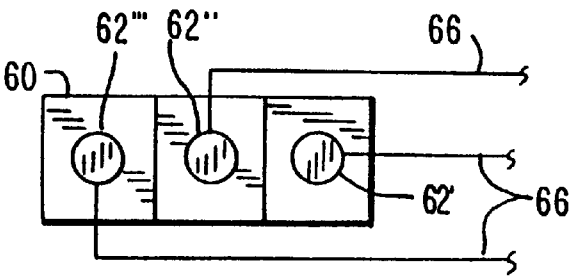
FIG. 7B is a top plan view taken along line B—B of FIG. 7.
Figure 7A:
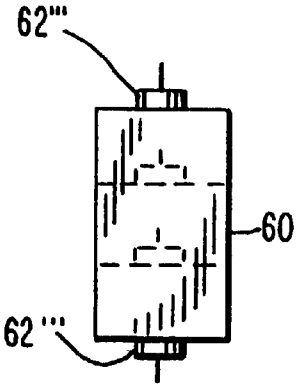
FIG. 7A is an end view taken along line A—A of FIG. 7.

With reference to FIG. 3, each downhole device preferably includes at least one reference block 60. As best shown in FIGS. 7, 7A and 7B, the reference block 60 can be in the form of a step-wedge, the configuration and operation of which is described in more detail below.

It will be understood from the above description that the activation of the transducers can be in accordance with any desired schedule or frequency, or on an essentially continuous basis. Also, any number of separate transducer arrays can be inserted in the tubing and/or casing strings as they are assembled and lowered into the well bore.

Figure 5:
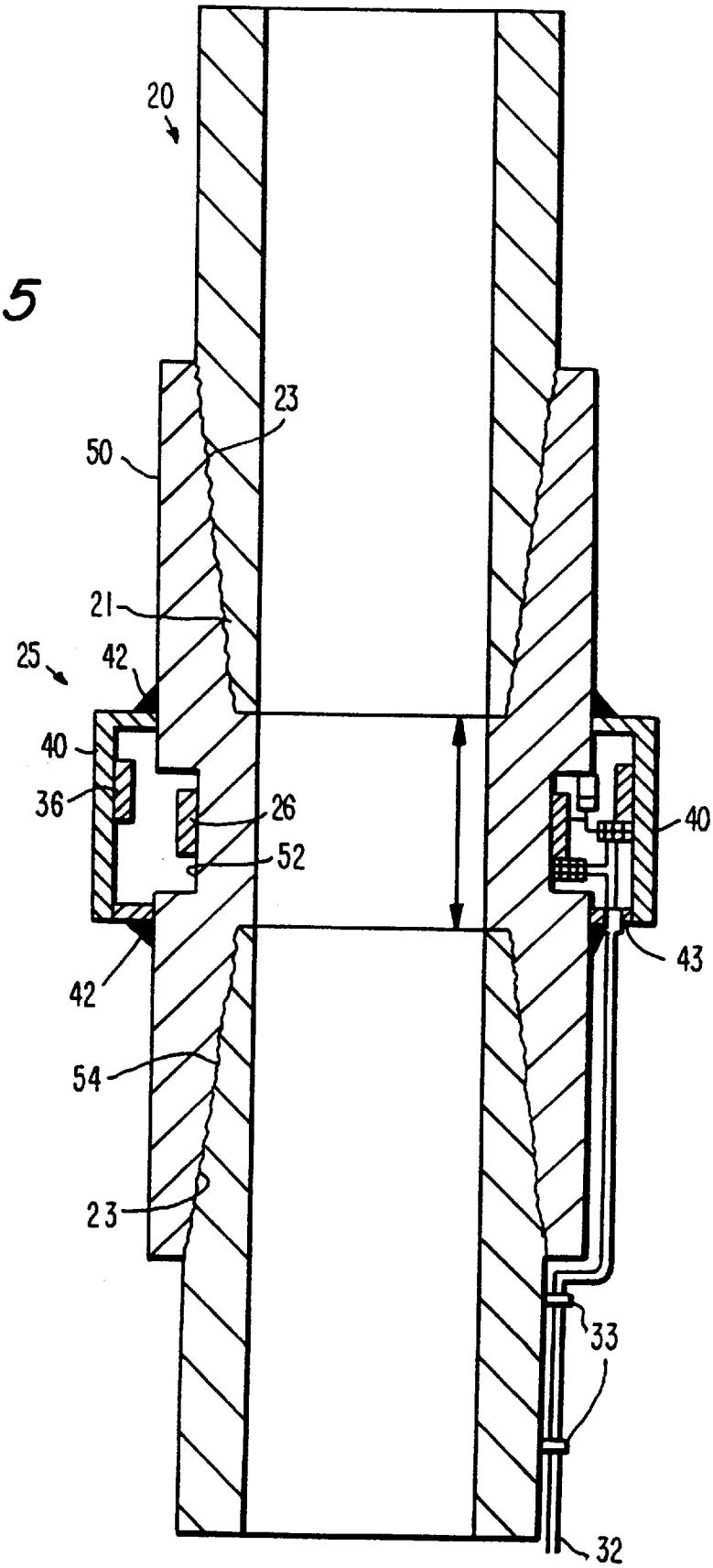
FIG. 5 is a cross-sectional view of a segment of well casing illustrating another preferred embodiment of the invention.

With reference to FIG. 5, there is shown another preferred embodiment where the transducer array is attached to a joint or pipe fitting 50 that is attached to the ends of individual lengths of tubing or casing pipes to join them together. The outer surfaces of the ends of the tubing or casing pipes are provided with a tapered configuration 23 which corresponds to the inner tapered surface 54 of joint or pipe filling 50. This junction of joint 50 and pipe ends can be effected by threaded surfaces, or other means to the art. In this embodiment, the joint 50 is fabricated from the same or similar type and grade of steel as the pipe and is provided with a groove 52 to have the transducers and microprocessor(s) to minimize the overall outside diameter of the pipe fitting with cover attached. This modified configuration of joint 50 is designed to maximize the clearance between the tubing and casing string or between the casing string and the rock, to minimize the risk of damage to the transducer arrays and microprocessors during installation. In accordance with the previously described embodiment, the transducers and associated microprocessor that are attached to modified joint 50 are provided with a protective cover 40 shown in FIG. 5. The advantages of attaching the transducer arrays 26 for monitoring internal pipe corrosion, and, optionally, transducer arrays 36 for monitoring exterior pipe corrosion, to the modified pipe joint 50 are several. Since the pipe joints must be installed in any event, no additional shorter monitoring pipe sections need be installed and the number of joints are kept to a minimum, thereby producing a savings in time, labor and money. Standard pipe fittings can be modified at little expense and installed using standard procedures and without special training of the work force. Most importantly, the intervals or spacing between sections of the string to be monitored is easily determined during installation of the pipe strings as is the final location of each of the monitoring points.

For example, if the individual sections of pipe are "L" feet in length, and monitoring for corrosion conditions at the deepest portion of the well is to be at intervals of 3 L feet, then a modified joint 50 is used to join each third section of pipe to the next as the string descends into the well.

In a further preferred embodiment, the apparatus of the invention includes a reference block 60, such as that schematically illustrated in FIG. 7. The reference block is fabricated from the same material as, or a material similar to the tubing or casing string being monitored, and as its names indicates will provide reference or comparative data on one or more thicknesses of material. The reference block is stepped and is provided with a plurality of transducers 62 affixed to its stepped surfaces and is installed so that it is isolated from the source of corrosion. In the embodiment of FIG. 7, the step-wedge reference block 60 is provided with transducers for three different thicknesses. The data received from each pair of transducers 62' and 62" and 62'" corresponds to the signal passed through sound metal, i.e., unaffected by corrosion, of the respective thicknesses. Each pair of transducers 62 is connected to microprocessor 64 by conductors 66. Microprocessor 64 is also joined by a conductor cable 32 to the surface control and instrumentation, if a wireless system is not being used. Since the reference block and its transducers will be subjected to the same conditions, e.g., of temperature and pressure, as the adjacent transducers attached to the tubing string being monitored, any variations in local conditions occurring over time that effect the reference block can be applied to the corrosion-related data as a base line, or correction factor.

In a preferred embodiment, the maximum thickness of the reference block, corresponding to transducer pair 62'", is the same as the wall thickness of the pipe being monitored. Thus, the relationship between the data from the respective transducers and associated microprocessors on the reference and pipe surfaces can be established even before the string is placed in the well bore. In the event that there is an onset of corrosion, its progress can be estimated by comparison with data obtained from reference block transducer pairs 62' and 62". As illustrated in FIG. 7, the thinnest portion of the block 60 can be established as the minimum thickness of pipe required or accepted for continuing operations, so that when data corresponding to this thickness is received form the monitoring transducers, that section is identified for replacement.

It will also be understood that conductor cable 32 will extend from each monitoring location along the string to the surface, if a wireless system is not being used. In a preferred embodiment, the conductor cable 32 extends in a parallel circuit between adjacent monitoring units 25, each unit having appropriate input/output sockets for electrically receiving and securing the cables against being dislodged during movement of the strings.

The main conductor cable 32 is secured to the surface of the tubing by clamps, ties or other means known to the art. The cable 32 is secured to prevent stretching and to protect the cable against mechanical wear and other damage. When required by local conditions, a well head pressure barrier and an electrical safety barrier are installed (not shown) and the cable is passed through these devices.

Figure 6:
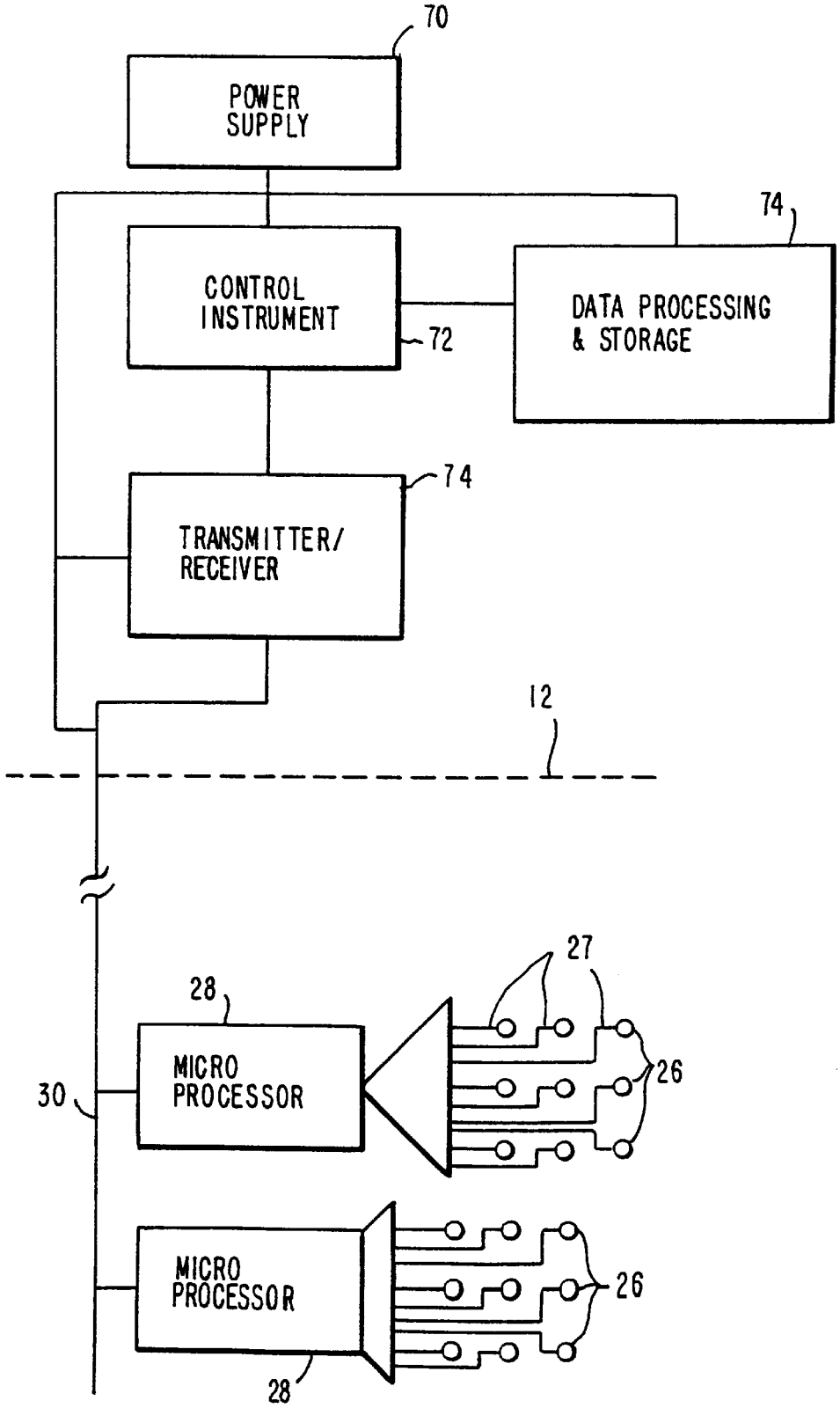
FIG. 6 is a schematic electrical diagram illustrating another preferred embodiment for wireless transmission of data.

The invention also contemplates the method of relaying the signals and data between the surface control means and the one or more downhole microprocessors 28 via cableless transmission means, as schematically illustrated in FIG. 6. In this embodiment, the cable 32 connecting the surface control means to the microprocessor(s) 28 is replaced by a transmitter/receiver electrically connected to the well tubing or casing which serves as the signal path.

The relationship of these elements is shown schematically in the block diagram of FIG. 6, where a plurality of microprocessors 28 and associated transducer arrays 26 are attached to, for example, tubing string 30. The power supply 70, control and instrumentation means 72 and data storage and processing means 74 are linked by appropriate electrical cables. In addition, transmitter/receiver 74 is electrically connected to the control instrumentation 72 and to the string 30 containing the transducer arrays 26.

Each microprocessor 28 is programmed or constructed to provide a unique identification signal so that its location on the string, and therefore its depth, is known. The microprocessor can also be programmed to identify each of its associated transducers for data recording and display purposes.

Each microprocessor associated with a reference block 60 is programmed or constructed to uniquely identify each transducer 62, e.g. 62', 62" and 62'" of FIG. 7, and the data derived from each such position on the step-wedge. In the practice of the method, a signal is transmitted from the surface control means to activate one or more downhole microprocessors 28, and that microprocessor's associated array of transducers, at one or more specified locations. Data received by each microprocessor from its associated array of transducers is transmitted back to the data receiving and processing means at the surface of the earth, along with that microprocessor's unique identification signal(s). The data associated with each microprocessor can either be entered directly, or first processed and then entered into the data storage means at a location corresponding to each of the microprocessor's unique identification code(s). The data can be retrieved for further processing, or for transmission to the data display means, e.g., a CRT monitor, or a printer which can produce a hard copy of the data in numerical and/or graphic form.

It will be understood that various modifications can be made to the embodiments disclosed above. Therefore, the description should not be construed as limiting, but merely as exemplifying preferred embodiments. Those of ordinary skill in the art will envision other modifications within the scope and spirit of the following claims.

I claim:

1. A downhole corrosion monitoring apparatus for determining the condition of a section of a well tubing string or a well casing string, the apparatus comprising:

(a) a plurality of piezoelectric transducers arranged in a fixed array, spaced longitudinally and axially from each other, and affixed about the circumference of the section of tubing or casing string to be monitored;

(b) a microprocessor electrically connected to the transducers for activating the transducers and for receiving and transmitting signals produced by the transducers;

(c) an electrical power source and conducting means extending from the power source to the microprocessor;

(d) control and instrumentation means for activating the microprocessor and for receiving, recording and processing the data output signals of the microprocessor; and (e) display means in association with the control and instrumentation means for displaying data relating to corrosion rate and location of defects in the section of the tubing or casing string.

2. The apparatus of claim 1 where the piezoelectric transducer comprises a material selected from the group consisting of quartz, ceramics, polymers and hybrids formed from quartz, ceramics and polymers.

3. The apparatus of claim 1 where a plurality of sections of a tubing string, or casing string, or both, are monitored for rate of corrosion.

4. The apparatus of claim 1 where the fixed array of transducers comprises at least three longitudinally spaced transducers.

5. The apparatus of claim 1 where the fixed array of transducers comprises a plurality of longitudinally spaced transducers extending 360° around the circumference of the tubing or casing string.

6. The apparatus of claim 1 in which the fixed array of transducers is attached to the exterior surface of a tubing or casing string.

7. The apparatus of claim 1 in which the fixed array of transducers is attached to the interior surface of a casing string.

8. The apparatus of claim 1 in which the transducers are attached to a section of the tubing or the casing string that is intermediate joint connectors.

9. The apparatus of claim 1 in which the transducers are attached to a joint connector, which joint connector is fabricated from a material that is the same as or similar to the material of the associated tubing or casing string.

10. The apparatus of claim 9 in which the joint connector is provided with a groove extending around its circumference, and the transducers are attached to the bottom of the groove.

11. The apparatus of claim 1 which further comprises at least one reference block that is isolated from the source of corrosion and a plurality of transducers affixed to the reference block.

12. The apparatus of claim 11 in which the reference block is made of a material that is same or similar to the material of the associated casing or tubing.

13. The apparatus of claim 11 in which the reference block has sections of differing thickness and at least two transducers are affixed to each such section.

14. The apparatus of claim 1 in which the transducers are surrounded by a protective cover.

15. The apparatus of claim 14, in which the protective cover is fabricated from a material that is the same as or similar to the material of the section of the tubing or casing string to which it is attached.

16. The apparatus of claim 15 in which a fixed array of transducers is attached to the interior surface of the protective cover.

17. The apparatus of claim 15 in which the microprocessor attached to the transducer array is enclosed by the protective cover.

18. The apparatus of claim 1 in which the microprocessor is located proximate the transducers to which it is connected.

19. The apparatus of claim 1 in which the fixed array of transducers is attached to a short section of tubing pipe or casing pipe for assembly into a string.

20. The apparatus of claim 16 where the electrical power source is selected from the group consisting of batteries, a DC power supply main, and, thermoelectric generators.

21. The apparatus of claim 20 where the power source is located at the surface proximate the tubing or casing section to be monitored.

22. A method for the downhole corrosion monitoring of at least one section of a well tubing string or casing string, said method comprising the steps of:

(a) attaching a plurality of piezoelectric transducers in a longitudinally and radially-spaced first fixed array on the surface of at least one section of one tubing string, or casing string, or both;

(b) electrically connecting a programmed microprocessor to the first fixed array of transducers and to a source of electrical power;

(c) providing control, data receiving, processing, display and storage means for transmitting electrical signals to and receiving signals from the microprocessor;

(d) transmitting signals to the microprocessor to activate the transducers;

(e) receiving signals from the transducers and transmitting the signals via the microprocessor to the data receiving and processing means;

(f) processing the data relating to the presence of corrosion and defects in the section of the string being monitored and displaying the processed data on the display means.

23. The method of claim 22 in which the signals to the microprocessor are transmitted intermittently.

24. The method of claim 22 comprising the further steps of:

providing a reference block fabricated from a material that is the same as or similar to the material of the string being monitored;

affixing the reference block proximate the first fixed array of transducers in isolated relation to the string;

obtaining data on the condition of the reference block from transducers and microprocessors associated with the block; and comparing the data relating to the condition of the reference block to the data relating to the section of the string being monitored.

25. The method of claim 22 in which a plurality of transducer arrays and electrically connected microprocessors are attached to a plurality of spaced-apart sections of the tubing or casing strings, or both the tubing and casing strings.

26. The method of claim 24 which comprises the further steps of:

providing a protective cover fabricated from a material that is the same as or similar to the material of the section of the string being monitored;

installing the cover to enclose the fixed array of transducers on the exterior surface of the section;

attaching a plurality of transducers and an associated microprocessor to the interior of the protective cover to form a second fixed array; and obtaining data from the first and second fixed arrays, to thereby determine the comparative internal and external condition of the surfaces of the section being monitored with respect to the reference block.

27. The method of claim 22 where the at least one section of well tubing or casing string is in a producing well.

* * * * *